United States Patent [19]

Frank

[11] Patent Number: 5,044,299

[45] Date of Patent: Sep. 3, 1991

[54] SEAT CONSTRUCTION FOR A BOAT

[76] Inventor: Ronald M. Frank, Box 6, Group 13, S.S. No. 1, Winnipeg, Manitoba, Canada, R3C 2E8

[21] Appl. No.: 518,702

[22] Filed: May 7, 1990

[51] Int. Cl.[5] ..... B63B 29/00

[52] U.S. Cl. ..... 114/363; 248/601; 297/345

[58] Field of Search ..... 114/363; 297/209, 344, 297/345, 349; 248/601

[56] References Cited

U.S. PATENT DOCUMENTS

| | | | |
|---|---|---|---|
| 187,748 | 12/1857 | Irwin | 248/601 X |
| 626,396 | 6/1899 | Smith | 248/601 X |
| 4,766,838 | 8/1988 | Johnson | 114/363 |

FOREIGN PATENT DOCUMENTS

| | | | |
|---|---|---|---|
| 2436588 | 5/1980 | France | 248/601 |
| 647183 | 8/1948 | United Kingdom | 248/601 |

OTHER PUBLICATIONS

Advertisement by Springfield for Boat Seat Supports pp. 24–27, Springfield Marine Company; Arixa, Missouri.

*Primary Examiner*—Sherman Basinger
*Attorney, Agent, or Firm*—Adrian D. Battison; Stanley G. Ade; Murray E. Thrift

[57] ABSTRACT

A seat construction for a boat comprises a support sleeve arranged for mounting on the boat with a longitudinal axis vertically of the boat. A seat support element is slidable longitudinally of the sleeve and is confined by an upper bearing element of the sleeve and a lower bearing element of the sleeve. A spring extends between the underside of a boss on the longitudinal pin forming the seat support member and an upper face of the lower bearing element so that the spring is confined within the sleeve member and has a relatively long extent of travel to provide effective flexibility of the seat to accommodate vertical shock.

9 Claims, 4 Drawing Sheets

SEAT CONSTRUCTION FOR A BOAT

BACKGROUND OF THE INVENTION

This invention relates to a seat construction of a type for mounting on a boat so as to provide a swivel seat with a resilient spring arrangement in a vertical direction so as to accommodate the vertical shock forces generated as the boat moves at higher speed across the water.

Swivel seats on boats are well known and are often provided for fishing boats to allow the person fishing to rotate the seat to take up various different directions in the boat for fishing or other purposes. For this purpose there is often provided a simple cup member which is attached to a suitable horizontal surface of the boat. Into the cup member is inserted a pin which can rotate relative to the cup member about a vertical axis. The pin is attached to the underside of a plate member which is then screwed or bolted to the underside of the seat. In addition arrangements can be provided in which there is an upstanding stem which projects from a cup mounted in the floor of the boat. The stem provides a further cup at the upper end into which the pin is inserted thus raising the seat to a suitable height from the floor to comfortably accommodate the rider.

Attempts have been made to provide a spring connection which allows the seat to have a spring suspension arrangement to accommodate the shocks often experienced as a boat travels at higher speed across the water. Up till now this has been simply achieved by providing a spring surrounding the shaft between the underside of the plate attached to the bottom of the chair and the top of the cup member. As this length is relatively short, this necessitates the use of a relatively short spring and in order to provide the sufficient degree of longitudinal movement, the spring has to be relatively weak or thin. Springs of this type are thus easily compressed beyond their elastic limit leading to permanent deformation and a permanent loss of the spring suspension.

SUMMARY OF THE INVENTION

It is one object of the present invention, therefore to provide an improved seat mounting system of this type for use in a boat which provides an improved spring suspension while allowing the required rotational movement and enabling the system to be mounted in a simple cup member which can be attached in the conventional manner.

According to the invention, therefore there is provided a seat construction for a boat comprising a support sleeve member, means on the sleeve member for mounting the sleeve member on the boat with a longitudinal axis thereof standing vertically of the boat, a seat support element for supporting an underside of a seat bottom, a shaft mounted on the seat support element so as to extend vertically downwardly therefrom to a free end thereof received within said sleeve member, a cylindrical abutment and bearing member having an end abutment surface lying in a radial plane of the shaft and facing downwardly of the shaft and a first cylindrical bearing surface facing outwardly of the shaft and coaxial with the shaft having a radius larger than that of the shaft, helical coil spring coaxially surrounding the shaft and having one end thereof in engagement with the abutment surface and an end opposed to said one end spaced from the free end of the shaft leaving a free portion of the peripheral surface of the shaft at the free end of the shaft, said support sleeve member including a second cylindrical bearing surface facing inwardly of the sleeve member cooperating with said first cylindrical bearing surface to accommodate the rotational and axial movement of said seat support element relative to said sleeve member, a third cylindrical bearing surface cooperating with said free portion of the shaft to accommodate said rotational and axial movement, an upper end of said third bearing surface defining an abutment surface lying in a radial plane for engaging said opposed end of the spring, and a connecting portion between said second and third bearing surfaces spaced outwardly from and surrounding the spring to allow compression and expansion of the spring in response to shock loads applied to the seat by an occupant.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
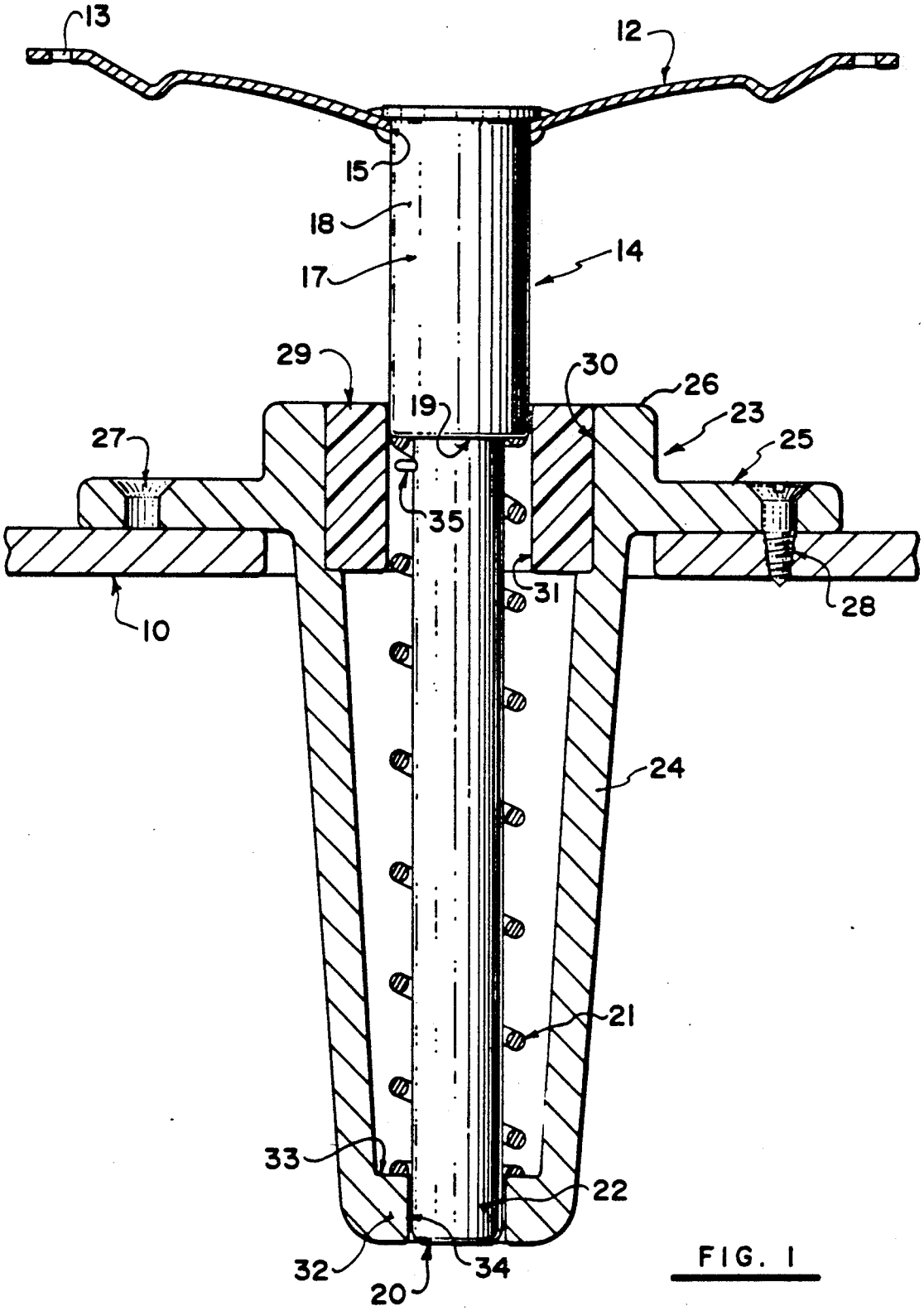
FIG. 1 is a cross-sectional view through a first embodiment of the seat construction according to the invention.

In FIG. 1 a horizontal supporting surface of a boat is indicated at 10 which often would comprise a horizontal seat already provided in the boat structure upon which is intended to be mounted a swivel and suspended seat for improved comfort of the occupant.

The seat construction includes a chair (not shown) mounted upon a horizontal support plate 12 which includes a plurality of holes 13 for screw fastening of the plate to the underside of the chair. The plate is welded to the top of a shaft 14. The plate has a central hole 15 surrounding the shaft and curves downwardly adjacent the hole 15 so that it engages the shaft at a position adjacent the top of the shaft. The top of the shaft includes a cap 16 engaging an upper side of the plate 12. The cap 16 is welded to the plate member. The plate member can also be welded to the shaft on the underside of the plate member. This provides a rigid support for the plate member at the top of the shaft.

The shaft is formed at its upper end with a surrounding collar 17 providing an abutment and bearing member 17 which is annular in shape and extends along a length of the shaft to provide an outer cylindrical surface 18 which forms a first bearing surface. An end face 19 of the member 17 provides an abutment surface facing axially of the shaft.

The shaft extends beyond the lower abutment end 19 to a remote end of the shaft indicated at 20. Between the abutment surface 19 and the position adjacent the end 20 is provided a spring 21 of the helical coil spring type which surrounds the shaft and can be compressed in an axial direction to provide a resilient suspension system. An end portion of the shaft 14 is exposed beyond the end of the spring 21 as indicated at 22 and this portion is therefore free from the spring and acts as a bearing portion located in the shaft as explained hereinafter.

The shaft is mounted within a sleeve member generally indicated at 23 including a cup portion 24 and a surrounding support flange 25. The cup portion 24 depends from the flange downwardly and tapers gradually inwardly from an open mouth at the upper end to a lower end at the lower end of the shaft. The cup portion 24 also includes an upstanding lip or rim 26 which projects upwardly from the upper surface of the flange by distance of the order of ⅝ inches. The flange has screw holes which allow the flange to be screwed to the surface 10 by for example screw 28.

The cup member includes a plastics insert 29 which is received as a press fit within a counter bore 30 formed in the cup member. An inner surface 31 of the insert 29 acts as a second bearing surface for cooperation with the outer surface of the bearing member 17 to allow sliding and rotation of the shaft portion relative to the cup member.

The lower most end of the cup member is turned inwardly as indicated at 32 to define an abutment surface 33 and a bearing surface 34 facing axially and radially of the axis to the shaft respectively.

The spring 21 therefore acts between the abutment surface 19 and the abutment surface 33. The spring is located in position by a pin 35 which projects outwardly from an opening in the shaft so as to engage an underside of one turn of the spring to hold the spring at the end adjacent the abutment surface 19 so that it remains in contact with the abutment surface 19 when the seat is pulled upwardly.

The upper and lower ends of the springs are machined so as to define a flat surface for engaging the abutment surface. The machined flat surface of the spring at the bottom can rotate relative to the abutment surface 33 to allow the rotation of the seat support portion.

Figure 2:
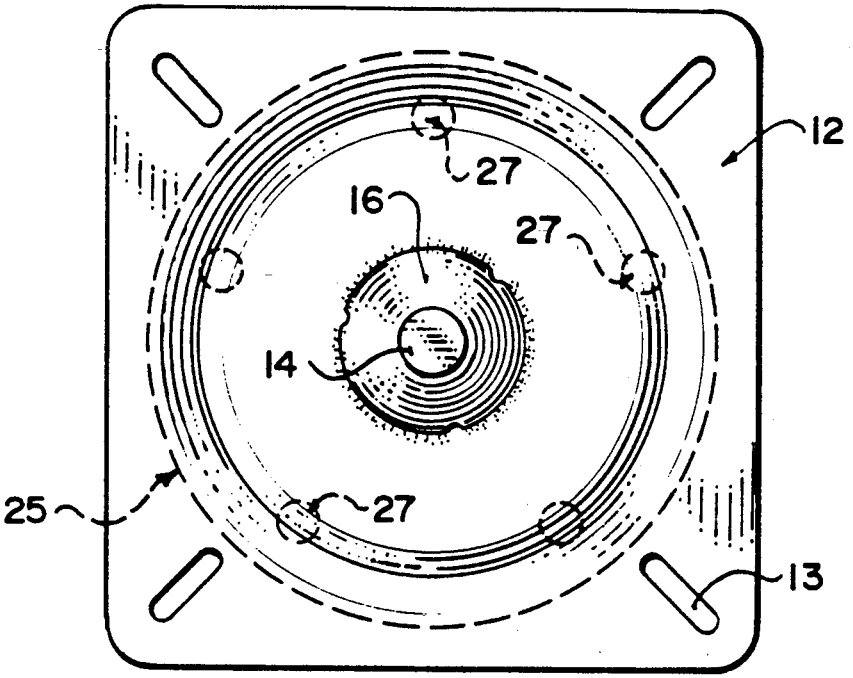
FIG. 2 is a top plan view of the seat construction of FIG. 1.
Figure 3:
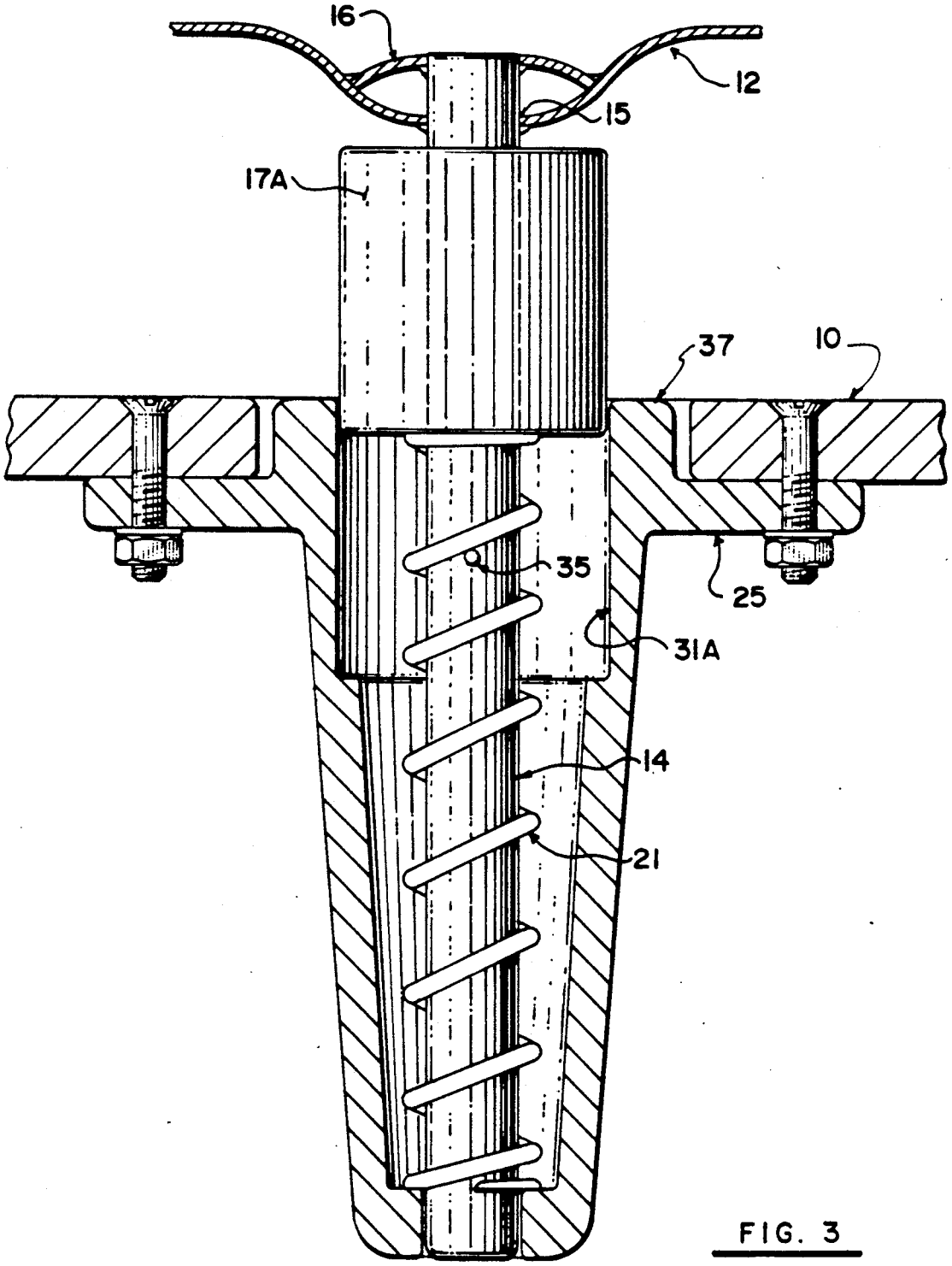
FIG. 3 is a similar cross sectional view through a second embodiment of seat construction.

The construction shown in FIG. 3 is substantially the same as that shown in FIGS. 1 and 2 apart from the following modifications.

Firstly the flange 25 is positioned on the underside of the support element 10 so that the top edge of the support element 10 is substantially coincident with the top edge of the cup member as indicated at 37 to form a flush fit thus enabling the upper surface of the support element 10 to be used as a conventional seat if the seat support element is removed.

Secondly the bearing and abutment element indicated at 17A is formed from a plastics material surrounding the shaft 14. The second bearing surface defined by the top part of the cup member is thus formed by machining the cup member to form a cylindrical inner surface 31A.

Figure 4:
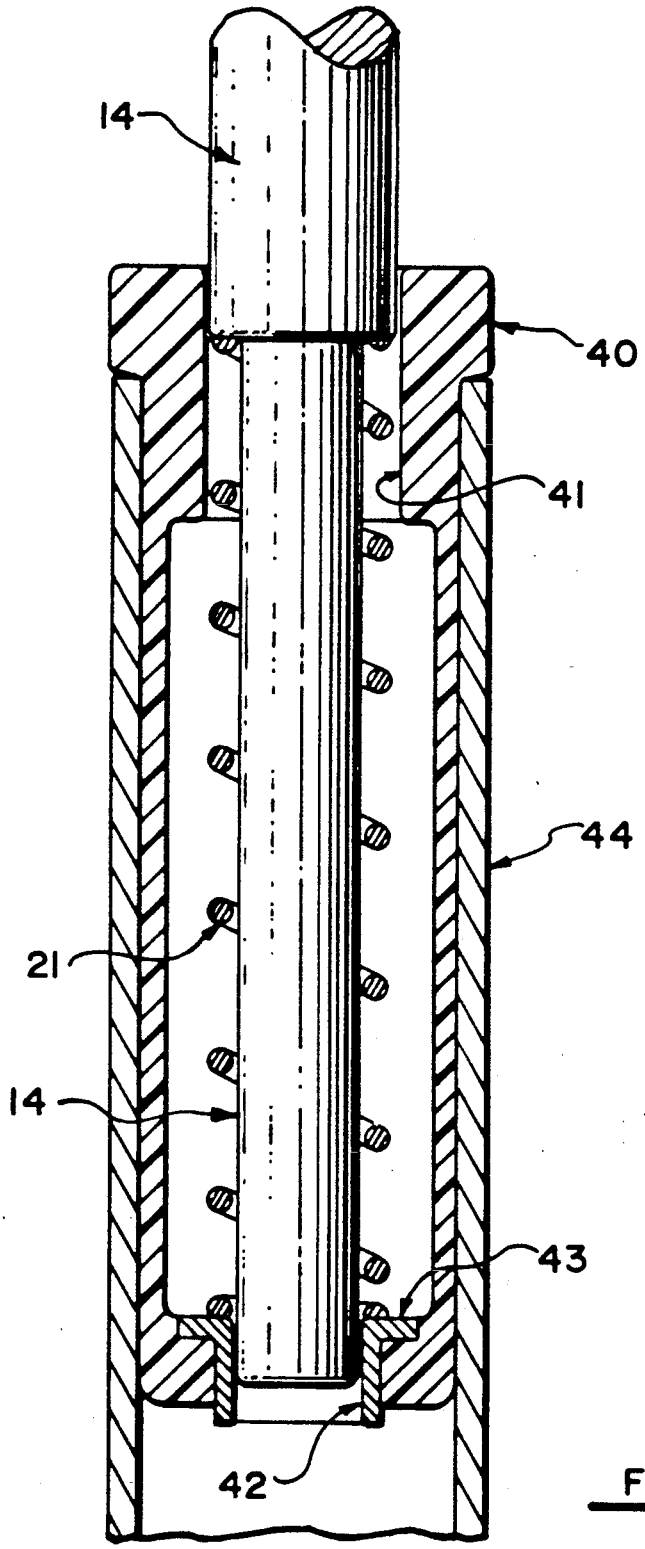
FIG. 4 is a similar cross sectional view through a further embodiment of seat construction omitting the top portion of the seat construction for convenience of illustration.

In FIG. 4 substantially the same construction is shown as previously except for the following modifications. Firstly the cup member is formed substantially wholly from a molded plastics material indicated at 40 which defines the upper or second bearing surface 41. A bushing of hard material is inserted at the lower end of the cup portion to define the third or lower bearing surface 42 together with the abutment surface 43. The outer dimension of the cup member molded in a single unitary piece from a plastics material is such that it can be received within a sleeve or tubular body 44 which is of the type conventionally used as a stem for the seat. The stem can thus be inserted in a conventional lower cup mounted in the floor of the boat and the resilient and rotatable seat construction mounted in the top of the conventional stem.

In an alternative arrangement (not shown) the construction molded substantially wholly from plastics and shown in FIG. 4 is modified to include a surrounding flange for mounting in the seat as shown in FIGS. 1 and 3.

The construction shown in the different embodiments defined above therefore provides a first and a second bearing element for the shaft, the first being provided at the top of the shaft and the second being provided right at the bottom of the shaft so that the shaft can move upwardly and downwardly in vertical movement it can also rotate. The sleeve portion surrounding the spring is spaced outwardly from the spring to allow sufficient space for compression and expansion of the spring. At the same time the spring used can be relatively large in view of the relatively long length available between the underside of the abutment member and the bottom of the cup. This longer spring can therefore be thicker and stronger allowing it to be more resistant and to accommodate greater loads.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A seat construction for a boat comprising a support sleeve member, means on the sleeve member for mounting the sleeve member on the boat with a longitudinal axis thereof standing vertically of the boat, a seat support element for supporting an underside of a seat bottom, a shaft directly and fixedly mounted on the seat support element so as to extend vertically downwardly therefrom to a free end thereof received within said sleeve member, a cylindrical abutment and bearing member fixedly mounted on the shaft and having an end abutment surface lying in a radial plane of the shaft and facing downwardly of the shaft and a first cylindrical bearing surface facing outwardly of the shaft and coaxial with the shaft having a radius larger than that of the shaft the radial extent of the abutment surface being no greater than the radius of the cylindrical bearing surface, a helical coil spring coaxially surrounding the shaft and having one end thereof in engagement with the abutment surface and an end opposed to said one end spaced from the free end of the shaft leaving a free portion of the peripheral surface of the shaft at the free end of the shaft, means attaching the spring to the shaft such that the spring is carried by the shaft when removed from the sleeve, the radial extent of the spring being less than the radius of the cylindrical bearing surface, said support sleeve member including a second cylindrical bearing surface facing inwardly of the sleeve member cooperating with said first cylindrical bearing surface to accommodate the rotational and axial movement of said seat support element relative to said sleeve member, a third cylindrical bearing surface cooperating with said free portion of the shaft to accommodate said rotational and axial movement, an upper end of said third bearing surface defining an abutment surface lying in a radial plane for engaging said opposed end of the spring, and a connecting portion between said second and third bearing surfaces spaced outwardly from and surrounding the spring to allow compression and expansion of the spring in response to shock loads applied to the seat by an occupant.

2. The invention according to claim 1 wherein one of said first and second bearing surfaces is formed of a plastics material.

3. The invention according to claim 1 wherein the seat support element comprises a plate member separate from the bottom of the seat and including openings therein for screw fastener attachment to the bottom of the seat, the plate member being welded to the top of the shaft.

4. The invention according to claim 1 including a pin member adjacent the abutment and bearing member mounted on the shaft and extending outwardly therefrom for locating the spring at a fixed position on the shaft.

5. The invention according to claim 1 wherein the second bearing surface is defined by a plastics insert carried by the sleeve member.

6. The invention according to claim 1 wherein the second bearing surface is defined by a cylindrical surface of the sleeve member and wherein the abutment and bearing member comprises an annular body formed of a plastics material and carried on an outer surface of the shaft.

7. The invention according to claim 1 wherein the sleeve member comprises a plastics insert member molded to define said second bearing surface and said third bearing surface and inserted into and carried by an outer tubular body defining a stem for the seat.

8. The invention according to claim 1 wherein said mounting means comprises a horizontal flange portion lying in a plane radial to the axis surrounding the sleeve member, the flange portion being spaced from an uppermost edge of the sleeve member to leave a rim portion of the sleeve member projecting upwardly from an upper face of the flange portion, the flange portion having a plurality of holes therethrough such that the flange portion can be screwed on top of a support surface of the boat with the sleeve member projecting downwardly through a hole in the support surface and alternately the flange portion can be screwed underneath a support surface with said rim portion projecting into a hole in the support surface to lie flush with an upper face of the support surface.

9. A seat construction for a boat comprising a support sleeve member, means on the sleeve member for mounting the sleeve member on the boat with a longitudinal axis thereof standing vertically of the boat, a seat support element for supporting an underside of a seat bottom, a shaft mounted on the seat support element so as to extend vertically downwardly therefrom to a free end thereof received within said sleeve member, a cylindrical abutment and bearing member having an end abutment surface lying in a radial plane of the shaft and facing downwardly of the shaft and a first cylindrical bearing surface facing outwardly of the shaft and coaxial with the shaft having a radius larger than that of the shaft, a helical coil spring coaxially surrounding the shaft and having one end thereof in engagement with the abutment surface and an end opposed to said one end spaced from the free end of the shaft leaving a free portion of the peripheral surface of the shaft at the free end of the shaft, said support sleeve member including a second cylindrical bearing surface facing inwardly of the sleeve member cooperating with said first cylindrical bearing surface to accommodate the rotational and axial movement of said seat support element relative to said sleeve member, a third cylindrical bearing surface cooperating with said free portion of the shaft to accommodate said rotational and axial movement, an upper end of said third bearing surface defining an abutment surface lying in a radial plane for engaging said opposed end of the spring, and a connecting portion between said second and third bearing surfaces spaced outwardly from and surrounding the spring to allow compression and expansion of the spring in response to shock loads applied to the seat by an occupant, wherein said mounting means comprises a horizontal flange portion lying in a plane radial to the axis surrounding the sleeve member, the flange portion being spaced from an uppermost edge of the sleeve member to leave a rim portion of the sleeve member projecting upwardly from an upper face of the flange portion, the flange portion having a plurality of holes therethrough such that the flange portion can be screwed on top of a support surface of the boat with the sleeve member projecting downwardly through a hole in the support surface and alternately the flange portion can be screwed underneath a support surface with said rim portion projecting into a hole in the support surface to lie flush with an upper face of the support surface.

* * * * *